US005501409A

United States Patent [19]

Grabher et al.

[11] Patent Number: 5,501,409

[45] Date of Patent: Mar. 26, 1996

[54] METHOD OF AND APPARATUS FOR WINDING ALL-THREAD BOBBINS

[75] Inventors: Bruno Grabher; Heinrich Strasser, both of Lustenau, Austria

[73] Assignee: Casati Carlo AG, Au, Switzerland

[21] Appl. No.: 161,237

[22] Filed: Dec. 2, 1993

[30] Foreign Application Priority Data

Dec. 3, 1992 [CH] Switzerland ..... 03716/92

[51] Int. Cl.[6] ..... B21C 47/24; B65H 63/00

[52] U.S. Cl. ..... 242/362.2; 242/20; 242/22

[58] Field of Search ..... 242/20–24, 28, 242/36, 158.1, 362.1, 362.2, 362.3, 470

[56] References Cited

U.S. PATENT DOCUMENTS

| | | | |
|---|---|---|---|
| 1,598,262 | 8/1926 | Ashworth . | |
| 1,688,058 | 10/1928 | Reed . | |
| 2,420,936 | 5/1947 | Davis | 242/362.2 |
| 2,780,191 | 2/1957 | Philips . | |
| 2,815,178 | 12/1957 | Cone . | |
| 2,889,120 | 6/1959 | Fitzgerald | 242/21 |
| 2,985,401 | 5/1961 | Gazet | 242/362.2 |
| 4,646,982 | 3/1987 | Spring | 242/21 X |
| 4,828,191 | 5/1989 | Ruge et al. | 242/36 X |

FOREIGN PATENT DOCUMENTS

| | | |
|---|---|---|
| 2003133 | 11/1969 | France . |
| 287111 | 6/1914 | Germany . |

*Primary Examiner*—Katherine Matecki
*Assistant Examiner*—Michael R. Mansen
*Attorney, Agent, or Firm*—Darby & Darby

[57] ABSTRACT

All-thread bobbins for use as sources of lower thread or underthread in sewing machines are formed by winding a thread onto a slender rotary spindle which extends across a winding chamber between and into aligned openings of two end walls which flank the chamber and at least one of which is adjustable axially of the spindle to vary the length of bobbins. The rotating spindle draws thread from a spool or from another suitable source of supply. When the bobbin in the chamber is fully grown, the spindle is extracted from the opening of one of the end walls and from the chamber and the distance between the end walls is increased to permit evacuation of the fully grown bobbin, e.g., by gravity. The thread between the source and the evacuated bobbin is engaged by tongs extendable into the chamber through the opening of the one end wall, and the thus engaged portion is looped and maintained in the opening of the one end wall in a position of readiness for engagement by and for winding around the spindle after the latter is again moved across the empty chamber and into the opening of the one end wall to proceed with the making of a next-following bobbin.

25 Claims, 3 Drawing Sheets

METHOD OF AND APPARATUS FOR WINDING ALL-THREAD BOBBINS

BACKGROUND OF THE INVENTION

The invention relates to improvements in methods of and in apparatus for making so-called all-thread bobbins. More particularly, the invention relates to improvements in methods of and in apparatus for automatically winding all-thread bobbins for use in sewing machines or for other purposes. Still more particularly, the invention relates to improvements in methods of and in apparatus for making all-thread bobbins of the class disclosed, for example, in German Pat. No. 287 111 granted Jun. 3, 1914 to Levy for a winding machine for the making of disc-shaped bobbins for use in sewing and knitting machines.

The lower thread or underthread for the making of seams in a sewing machine is normally stored on a reel which is removably confined in a gripper housing or casing. During each of a series of stitch formations, the housing or casing is once surrounded by a looped portion of the upper thread which passes through the eye of the needle in the sewing machine. The space which is available in the sewing machine for the aforementioned housing or casing containing a supply of convoluted underthread is very limited, and additional space is taken up by the housing or casing as well as by the reel which actually stores the supply of convoluted underthread. The reel is normally made of a metallic or plastic material and often includes a central core between two disc-shaped flanges. The supply of convoluted underthread is wound around the core in the space between the two flanges.

Another drawback of reels for supplies of underthread is that, when the convoluted thread is to be drawn off the reel, the reel must be accelerated from zero speed. The inertia to be overcome during each acceleration of the reel is quite pronounced, especially when the reel still contains a full supply or a relatively large supply of convoluted underthread. The result is a continuous variation of tension upon the thread and the making of nonuniform stitches.

The aforementioned German Pat. No. 287 111 to Levy discloses a winding machine which is to turn out disc-shaped bobbins consisting entirely of convoluted thread or yarn. The winding operation involves the utilization of a large-diameter winding shaft between two flanges having axial passages for the axially reciprocable and rotatable winding shaft. When the making of a bobbin is completed, the shaft is withdrawn from the space between the flanges, i.e., from the center of the freshly formed bobbin, and leaves therein a relatively large axially extending hole. During the making of a bobbin between the flanges, the rotating shaft draws thread from a source of supply and through a thread guide. The latter is designed in such a way that, when a fully grown bobbin is evacuated from the space between the flanges upon extraction of the shaft from such space, a portion of the thread is placed in front of a specially configurated (crown-shaped) end portion of the shaft so that the shaft engages and begins to wind the thread as soon as it is returned to the winding position in which it extends across the space between the two flanges. The thread is thereupon severed between the shaft and the evacuated bobbin, and the thread guide is returned to its normal position preparatory to setting of the shaft in rotary motion in order to proceed with the winding of a fresh bobbin.

In addition to turning out bobbins having large-diameter holes, the machine of Levy exhibits the drawback that the thread guide must be capable of positioning a portion of the thread with a very high degree of accuracy, namely so that the thread crosses an extension of the longitudinal axis of the shaft; this should ensure that the end portion of the shaft will properly engage the thread preparatory to winding of a fresh bobbin. This is possible only by employing accurately finished, mounted and predictably manipulated thread guides as well as by employing means for reliably holding a fully grown bobbin in a predetermined position. If the fully grown bobbin is out of such predetermined position, the thread guide cannot engage the thread and cannot locate the thread in a requisite position relative to the end portion of the shaft. The end portion of the shaft is to force the properly positioned portion of the thread into a socket of one of the flanges; this can result in damage to or in actual tearing of the thread. Such damage to or tearing of the thread can create problems in connection with proper engagement of the guided thread portion with the end portion of the shaft. The diameter of the shaft cannot be reduced at will because the front end portion of the shaft must have dimensions which are sufficient to ensure proper engagement of the thread. In other words, it is necessary to provide each disc-shaped bobbin with a large-diameter hole at the expense of overall quantity of convoluted thread.

U.S. Pat. No. 1,598,262 (granted Aug. 21, 1926 to Ashworth for "Cop-Winding Machine") discloses an apparatus for converting thread into a cop which is merely a mass of thread and wherein the turns are held together by wax. The patentee is primarily concerned with a knock-off lever which is operable to move between two winding flanges in order to expel a completed cop upon extraction of the winding shaft.

French patent application Ser. No. 2,003,133 (filed by Plutte, Koecke & Co. for a thread winding apparatus and a bobbin which is obtainable by resorting to such apparatus and published Nov. 7, 1969) proposes an apparatus for the making of a cylindrical all-thread bobbin with a large axial hole. The applicant is concerned with a device which serves to strip a fully grown all-thread bobbin off a rotary winding spindle.

U.S. Pat. No. 1,688,058 (granted Oct. 16, 1928 to Reed for "Cop-winding Machine") discloses an apparatus for the making of flat disk-like cops from waxed thread. The winding shaft can be driven only when it assumes an operative position of engagement with a driving shaft. At such time, the driving shaft can turn the winding shaft by way of a torque transmitting clutch.

U.S. Pat. No. 2,780,191 (granted Feb. 5, 1957 to Philips for "Sewing machine bobbins of either silk, cotton, nylon or other fibres or synthetic material, and methods of making the same") discloses all-thread bobbins and a method of making such bobbins. A finished all-thread bobbin is heated to a temperature of substantially 300° F. and is simultaneously subjected to a pressure of approximately 1000 pounds applied axially and radially for time periods varying according to the type of material being processed. This is intended to cause coherent setting of thread into a substantially solid and rigid cylindrical mass.

U.S. Pat. No. 2,815,178 (granted Dec. 3, 1957 to Cone for "Thread package winding apparatus") proposes to wind thread on plastic sewing machine bobbins. The mass of thread which is being wound upon a plastic bobbin is compacted by urging it into radial engagement with a winding spindle. A wound bobbin is doffed and the patented apparatus employs conveyor means for removing doffed bobbins as well as for supplying empty bobbins. The apparatus of Cone is designed to simultaneously wind thread onto a plurality of plastic bobbins.

OBJECTS OF THE INVENTION

An object of the invention is to provide a novel and improved method of making compact all-thread bobbins, for example, to be used to supply underthreads in sewing machines.

Another object of the invention is to provide a method which renders it possible to reliably and predictable couple a thread with a rotary winding spindle.

A further object of the invention is to provide a method which renders it possible to make all-thread bobbins containing more thread per unit volume than heretofore known all-thread bobbins.

An additional object of the invention is to provide a method which can be practiced by resorting to relatively simple, compact and inexpensive winding apparatus.

Still another object of the invention is to provide a fully automatic method which can be utilized for the making of short or long series of identical all-thread bobbins in rapid succession.

A further object of the invention is to provide a novel and improved all-thread bobbin which is obtained in accordance with the above outlined method.

Another object of the invention is to provide a novel and improved all-thread bobbin which can be utilized in existing sewing machines and/or in other thread processing machines or production lines.

An additional object of the invention is to provide an all-thread bobbin which is formed with a small-diameter central passage or hole.

Still another object of the invention is to provide a novel and improved winding apparatus for the practice of the above outlined method and for the making of the above outlined novel and improved all-thread bobbins.

A further object of the invention is to provide the winding apparatus with novel and improved means for temporarily securing a portion of thread to a rotary winding spindle or shaft.

Another object of the invention is to provide a novel and improved apparatus for converting selected lengths of thread into compact all-thread bobbins which can be utilized in sewing machines and/or for other purposes.

An additional object of the invention is to provide a winding apparatus whose operation can be automated to a desired extent and which can be rapidly converted for the making of larger-diameter, smaller-diameter, shorter or longer all-thread bobbins.

Still another object of the invention is to provide the apparatus with novel and improved means for controlling the direction of movement of thread from a source of supply to the winding or bobbin forming station.

A further object of the invention is to provide the apparatus with novel and improved means for selecting the extent of oscillation of thread between the source and the winding station.

SUMMARY OF THE INVENTION

One feature of the present invention resides in the provision of a method of making an all-thread bobbin on a rotary spindle between first and second end walls (e.g., in the form of rotary flanges or discs) at least one of which is adjustable axially of the spindle to define with the other end wall a winding chamber of selected length. The improved method comprises the steps of establishing a source of thread having a portion extending into the chamber, moving the spindle axially across the chamber between the end walls and into an opening of the first end wall, rotating the spindle to wind the portion of and thereupon additional thread around the spindle in the chamber with attendant formation of a growing bobbin, shifting the thread back and forth between the end walls intermediate the source and the growing bobbin so that the growing bobbin extends across the chamber between the end walls, arresting the spindle when the bobbin in the chamber is fully grown by containing a predetermined quantity of thread, extracting the spindle from the opening and from the bobbin in the chamber, moving the at least one end wall away from the other end wall to thus permit evacuation of the grown bobbin from the chamber, grasping a second portion of the thread between the evacuated bobbin and the source, withdrawing the thus grasped second portion of the thread into the opening of the first end wall, and thereupon moving the spindle across the chamber and back into the opening to engage the withdrawn second portion of the thread preparatory to renewed rotation for the winding of thread therearound, i.e., for the making of a next-following all-thread bobbin.

The first and second end walls preferably have confronting substantially parallel and substantially plane thread-contacting surfaces, and the source can contain a supply of convoluted thread.

The withdrawing step can include looping the grasped second portion of the thread.

The method further comprises the step of severing the thread between the second portion and the evacuated fully grown bobbin.

The grasping step can include clamping the second portion of the thread by tongs or by another suitable implement and pulling the thus clamped second portion from the chamber into the opening of the first end wall. The pulling step can include advancing the looped second portion of the thread all the way through an opening extending through the entire first end wall.

The method can further comprise the step of pressing the growing bobbin in the chamber substantially radially inwardly toward the rotating spindle. Such pressing step can include biasing a rotary body, such as an idler roller, against the periphery of the growing bobbin, preferably with a variable force.

The method can further comprise the step of rotating at least one of the end walls by the growing bobbin in the chamber.

The shifting step can include guiding the thread through an eyelet at one end of a pendulum which is oscillated between first and second positions at least close to the respective end walls. The extent of shifting the thread back and forth can be varied, particularly in dependency on selected distance between the two end walls.

Another feature of the present invention resides in the provision of an apparatus for winding all-thread bobbins. The improved apparatus comprises a support (e.g., a frame or housing), a rotary spindle which is axially movably mounted in the support, and first and second end walls which are mounted in the support and define between themselves a winding chamber. The end walls have aligned openings for the spindle, and the apparatus further comprises means for rotating the spindle to thereby wind a thread, which is supplied by a source of supply, and to thus form in the chamber a growing bobbin between the two end walls. The apparatus also comprises means for moving the spindle axially in one of the openings across the chamber into the other opening and for extracting the spindle from the other opening and from the chamber, and at least one of the end walls is adjustable relative to the other end wall to permit evacuation (upon extraction of the spindle from the chamber) of a fully grown bobbin containing a predetermined quantity of thread. The apparatus also comprises means for grasping a portion of the thread between the source and the evacuated fully grown bobbin, and such grasping means includes means for pulling the grasped portion of the thread into the other opening upon extraction of the spindle from such other opening.

The apparatus also comprises means (e.g., in the form of a knife or shears) for severing the thread between the evacuated fully grown bobbin and the winding chamber, and means for shifting the thread back and forth between the end walls intermediate the source and the growing bobbin in the chamber to thus ensure predictable distribution of thread between the end walls.

The grasping means can comprise means for looping the aforementioned portion of the thread in the chamber between the source and the evacuated fully grown bobbin as a result of pulling the portion of the thread from the chamber into the other opening.

The source can contain a supply of convoluted thread and the aforementioned portion of the thread is preferably engaged by and is compelled to rotate with the spindle upon renewed movement of the spindle into the other opening and upon renewed rotation of the spindle whereby the thread is drawn from the source and is wound around the spindle to form a further growing bobbin in the chamber.

The pulling means can comprise means for reciprocating the looping means substantially axially of the spindle through the other opening into and out of the chamber upon extraction of the spindle from the other opening and from the chamber. The looping means can comprise tongs for an analogous implement which is operable to clamp the thread in the chamber upon evacuation of the fully grown bobbin and prior to severing of the thread between the evacuated bobbin and the winding chamber.

The spindle can comprise a suitably configurated and/or dimensioned end portion which cooperates with the end wall having the other opening to non-rotatably engage the spindle with the looped portion of the thread in the other opening upon renewed movement of the spindle into the other opening.

The shifting means can comprise an oscillatable thread engaging device and means for oscillating the thread engaging device between the end walls. The thread engaging device can include a pendulum and the means for oscillating can comprise means for repeatedly moving the pendulum into actual abutment with at least one of the end walls. The shifting means can further comprise means for varying the extent of oscillation of the thread engaging device, particularly in dependency upon the adjustment of the at least one wall relative to the other wall, as seen in the axial direction of the spindle.

The thread engaging device can be designed and mounted in such a way that it is oscillatable about a second axis which extends transversely of the axis of the spindle and is located between the planes of the two end walls. Such device can have a first portion or arm which engages the thread between the source and the growing bobbin, and a second portion or arm which is connected with the oscillating means. The first arm can have a variable length between the second axis and the engaged thread to thus vary the extent of oscillation of engaged thread between the two end walls. Alternatively or in addition to the just described mode of selecting the extent of oscillation of engaged thread between the two end walls, the adjustment can be carried out in such a way that the shifting means further comprises means for coupling the oscillating means with the second arm of the thread engaging device at any one of a plurality of different distances from the second axis to thereby select the extent of oscillation of the engaged thread between the two end walls.

The apparatus can further comprise means for pressing the growing bobbin substantially radially inwardly toward the spindle in the winding chamber. Such pressing means can comprise a rotary body (e.g., an idler roller) and means (such as a fluid-operated motor) for biasing the rotary body against the periphery of the growing bobbin, preferably with a variable force in addition to, or in lieu of, the just described pressing action, the rotary body or an equivalent thereof can be used as a means for monitoring the growth of the bobbin in the winding chamber.

The novel features which are considered as characteristic of the invention are set forth in particular in the appended claims. The improved winding apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
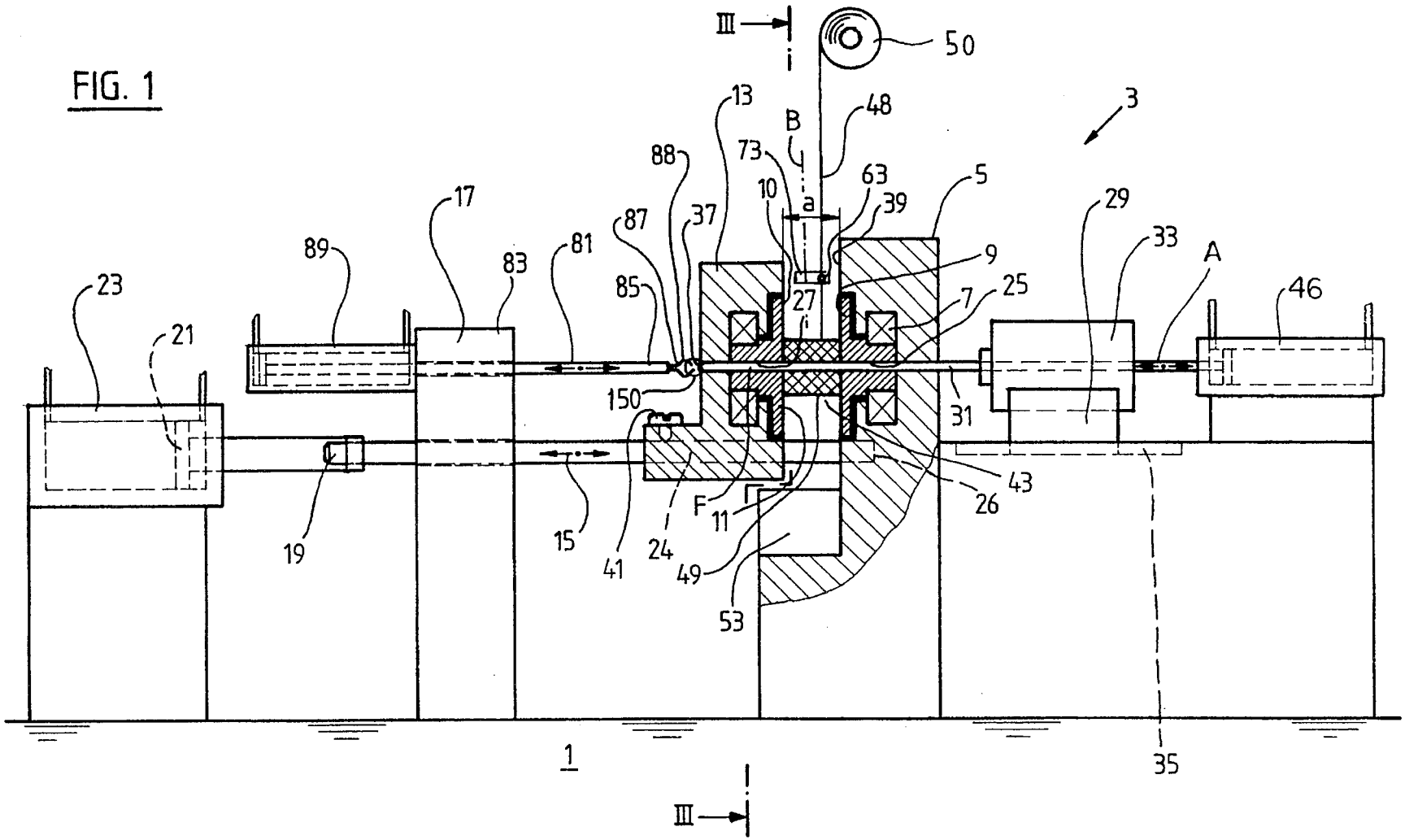
FIG. 1 is a somewhat partly front elevational and partly longitudinal vertical sectional view of a winding apparatus which embodies one form of the present invention, the view being taken substantially as seen in the direction of arrows from the line I—I in FIG. 2.
Figure 2:
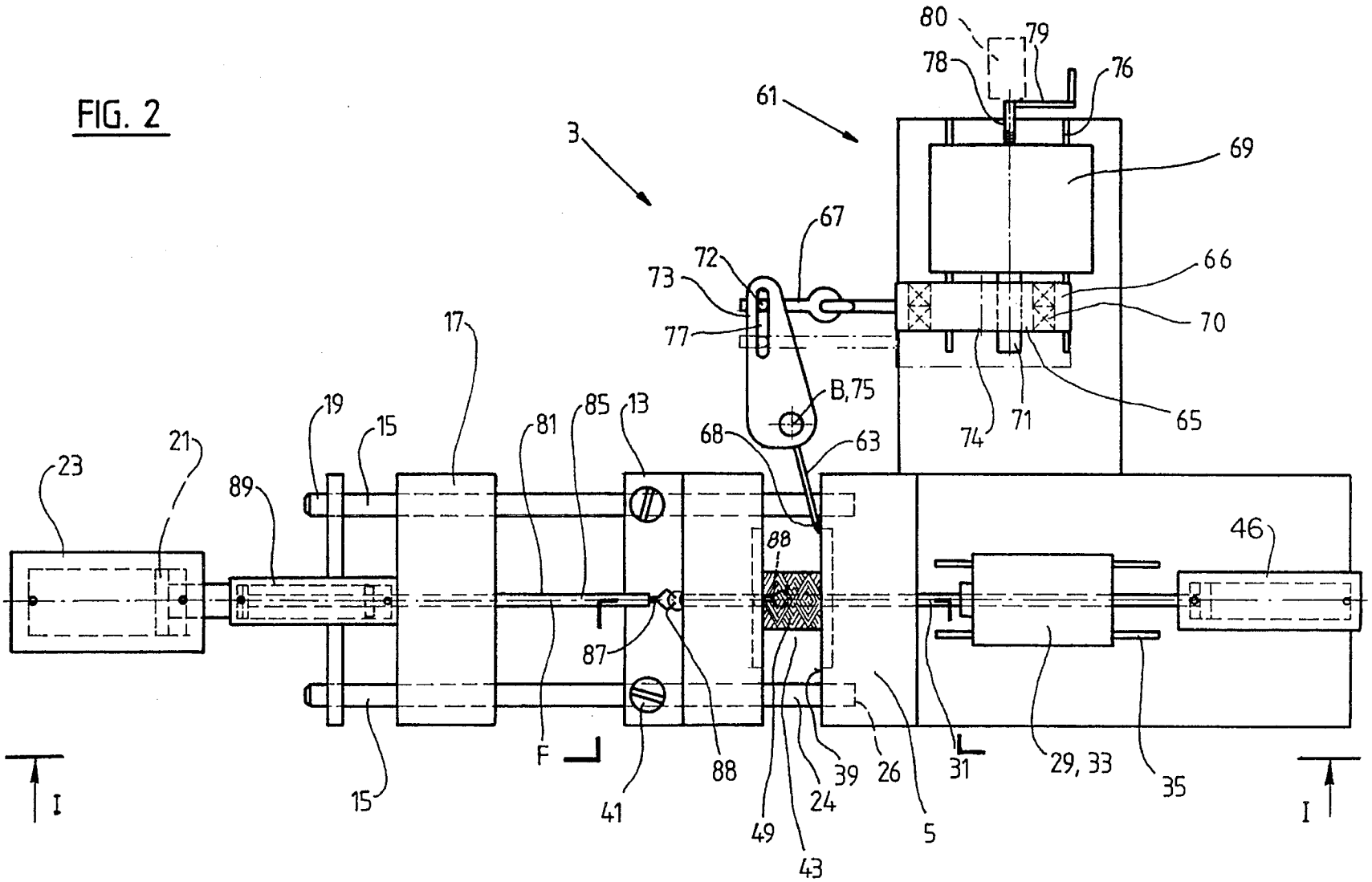
FIG. 2 is a schematic plan view of the winding apparatus which is shown in FIG. 1.
Figure 3:
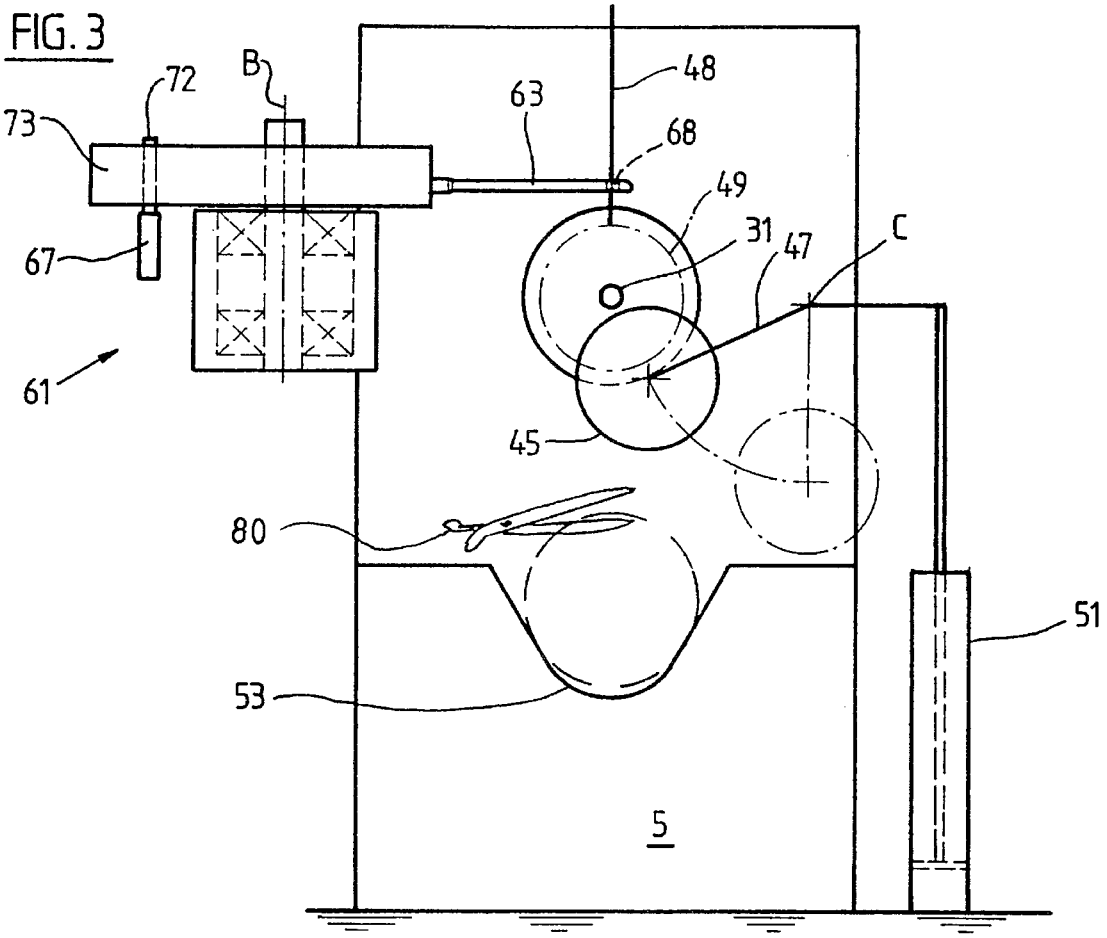
FIG. 3 is an enlarged schematic transverse vertical sectional view substantially as seen in the direction of arrows from the line III—III in FIG. 1.

The winding apparatus 3 which is shown in FIGS. 1, 2 and 3 comprises a support or frame including a base 1 and an upright carrier 5 on the base. The carrier 5 mounts an antifriction ball bearing 7 for an end wall 9 here shown as a rotary disc or flange having a central through opening or hole 25 for a portion of a horizontal winding spindle or shaft 31. The end wall 9 is freely rotatable in the bearing 7. An additional end wall 11 in the form of a rotary disc or flange with a centrally located through opening or hole 27 is adjacent to but spaced apart from the end wall 9, and the end wall 11 is rotatably mounted in a second antifriction bearing which is installed in a reciprocable adjusting or moving member 13. The at least substantially plane vertical surface 10 of the end wall 11 confronts and is at least substantially parallel to a similar plane surface of the end wall 9 and defines therewith a variable-length winding chamber 43 for the making of successive all-thread bobbins 49. The adjusting or moving member 13 for the end wall 11 is reciprocable with two elongated parallel rod-shaped guides 15 which are reciprocably installed in a fixed upright carrier 17 on the base 1. The parts 1, 5 and 17 can be said to constitute or form part of the frame of the improved winding apparatus 3. The rear end portions 19 of the guides 15 extend beyond the carrier 17 and are connected with the piston 21 of a fluid-operated motor 23 mounted in or on a further carrier on the base 1. The guides 15 extend forwardly through the member 13 and their front end portions 24 are reciprocably guided in blind bores 26 provided therefor in the carrier 5 at a level beneath the winding chamber 43.

The openings or holes 25, 27 of the end walls 9, 11 are aligned and serve to guide the winding spindle 31 which is connected to the piston rod of a fluid-operated motor 46 serving as a means for moving the spindle axially across the winding chamber 43 into the opening 27 as well as for extracting the spindle from the opening 27 and chamber 43 so that the front end portion 37 of the spindle is then located in the opening 25 of the end wall 9. The means for rotating the spindle 31 about its longitudinal axis F includes an electric motor 33 whose housing is mounted in a bearing 29 on a rear portion of the carrier 5. The upper side of such rear portion of the carrier 5 has elongated tracks 35 along which the motor 33 and the spindle 31 are movable forwardly (toward the carrier 17) or backwards in response to actuation of the motor 46.

The dimensions of the aligned openings 25, 27 in the end walls 9, 11 are selected in such a way that these openings can receive portions of the rotary winding spindle 31 with little radial clearance or with minimal radial clearance. The length of the tracks 35, which determine the extent of axial reciprocatory movement of the spindle 31, is selected in such a way that the spindle can be retracted to a rear end position in which its front end portion 37 is confined in the opening 25, i.e., in which the end portion 37 does not project beyond the plane vertical surface 39 of the end wall 9 (and carrier 5) and into the winding chamber 43.

The length of the winding chamber 43 can be selected and thereupon maintained by moving the member 13 and the end wall 11 therein along the guides 15, and by thereupon securing the member 13 to the guides 15 by suitable threaded or other fasteners 41. The selected length a (as seen in the axial direction of the spindle 31) of the winding chamber 43 (i.e., the distance of the surfaces 10, 39 from each other), thereupon remains unchanged as long as the person in charge desires the winding apparatus 3 to turn out a series of all-thread bobbins 49 having identical lengths (a). The motor 23 is actuated to retract the member 13, the end wall 11 and the guides 15 from the front end positions of FIG. 1 when a fully grown bobbin 49 is to be evacuated from the winding chamber 43. The motor 23 is thereupon actuated again to return the member 13 and its end wall 11 to the positions of FIG. 1 preparatory to renewed winding of thread 48 for the making of the next-following bobbin. The fasteners 41 are loosened to permit movements of the carrier 13 (with end wall 11) and guides 15 relative to each other only when the person in charge (or an automatic control system) is to change the distance a, namely the length of the winding chamber 43 and hence the axial length of the next-following bobbins which are to be formed between the surfaces 10 and 39 of the end walls 11 and 9, respectively.

The winding apparatus 3 further comprises means for pressing a growing bobbin 49 in the winding chamber 43 radially inwardly toward the axis of the rotating spindle 31. At such time, the spindle 31 extends across the chamber 43 from the opening 25 in the end wall 9 at least into or all the way through the opening 27 of the end wall 11, and the thread 48 is being wound around the spindle between the surfaces 10 and 39. The pressing means comprises a rotary body 45 (e.g., an idler roller) whose axis is parallel to the axis F of the spindle 31) and which is mounted on one or two supporting arms 47. Such arm or arms 47 are pivotable about a horizontal axis C which is or can be parallel to the axis F of the spindle 31. The means for biasing the peripheral surface of the rotary body 45 against the periphery of a growing bobbin 49 in the chamber 43, preferably with a variable force, includes a fluid-operated motor 51. As can be seen in FIG. 3, the arm or arms 47 serving to support the rotary body 45 can be installed in the support of the winding apparatus 3 in such a way that the body 45 is pivotable into the chamber 43 from below and bears against successive increments of the periphery of the growing bobbin 49 which is being formed in the chamber 43 as a result of rotation of the spindle 31 under the action of the motor 33. The latter further serves to arrest the spindle 31 when the chamber 43 contains a fully grown bobbin 49, i.e., when such bobbin contains a predetermined quantity of thread 48. In addition to serving as an element of the aforediscussed bobbin pressing means, the rotary body 45 can also serve as a component of means for monitoring the diameter of the growing bobbin 49 in the chamber 43 and for arresting the motor 33 when the diameter of the bobbin reaches a value indicating that the bobbin contains a requisite (predetermined) quantity of thread.

The motor 51 is actuated to retract the rotary body 45 from the chamber 43 when the making of a bobbin 49 is completed; this provides room for automatic or other evacuation of the fully grown bobbin from the chamber 43, for example, by gravity into a compartment 53 at a level beneath the chamber 43. The compartment 53 is accessible for manual, semiautomatic or automatic extraction of a fully grown bobbin 49 and for transfer of such bobbin to storage or to any other destination.

A source 50 of supply of thread 48 can include a relatively large reel of convoluted thread at a level above the winding chamber 43. The manner in which the quantity of thread 48 in the source 50 is monitored, the manner in which an empty reel is replaced with a fresh reel and/or the manner in which empty reels are evacuated (e.g., ejected) from the station for a supply of thread 48 form no part of the present invention. The same holds true for the manner of utilizing signals generated by the rotary body 45 to arrest the motor 33 (and hence the spindle 31) when the bobbin 49 in the chamber 43 contains a requisite quantity of thread 48, and for the manner in which the motor 51 can be adjusted to vary the bias of the rotary body 45 upon the periphery of a growing bobbin 49 in the chamber 43. It is preferred to design and set up the motor 51 in such a way that the bias of the rotary body 45 upon the periphery of a growing bobbin 49 in the winding chamber 43 remains at least substantially constant. It is presently preferred to employ a pneumatic motor 51 and to cause the piston rod of such motor to act upon a two-armed supporting and biasing structure for the rotary body 45. Thus, the latter can be mounted on at least one lever which is fulcrumed at C, which has a first arm articulately connected to the piston rod of the motor 51 and a second arm (47 in FIG. 3) supporting a shaft for the rotary body 45.

The aforementioned compartment 53 can be defined by a tray which is removably installed in the carrier 5 beneath the winding chamber 43. The tray defining the compartment 53 can be utilized in addition to or in lieu of a suitable handling element (such as a doffer) which is designed to grasp a fully grown bobbin 49 and to extract it from the chamber 43 preparatory to delivery onto a suitable conveyor or preparatory to immediate delivery to a treating station, not shown.

The winding apparatus 3 further comprises means (shown at 61) for shifting the thread 48 back and forth intermediate the end walls 9 and 11 during the making of a bobbin 49 in the winding chamber 43. Such shifting means ensures that the thread 48 forming part of a fully grown bobbin 49 is distributed in a desired manner axially and/or radially of that portion of the spindle 31 which extends across the chamber 43 between the openings 25 and 27. The illustrated shifting means 61 is mounted on a suitable carrier on the base 1 behind the carrier 5 (see FIGS. 2 and 3). A composite thread engaging device of the shifting means 61 resembles a pendulum having a first portion 63 extending or extendable into the space between the surfaces 10 and 39 of the end walls 11, 9, respectively, and a second portion 73 which carries the lower portion 63 and is oscillatable about a vertical axis B in response to operation of an oscillating unit including an electric motor 69 or another suitable prime mover. The vertical axis B is defined by a stationary pivot member 75 and is located between imaginary extensions of the surfaces 39 and 10 of the respective end walls 9 and 11. The surface 39 is preferably flush with the adjacent (surrounding) surface of the carrier 5, and the surface 10 is preferably flush with the adjacent (surrounding) surface of the member 13. The axis F of the spindle 31 is or can be horizontal, i.e., normal to the vertical axis B of the pendulum including the portions 63 and 73.

A portion of the thread 48 coming from the source 50 and advancing into the winding chamber 43 is caused to pass through an eyelet 68 at the lower end of the portion 63 of the pendulum forming part of the shifting means 61. The rotary output element 71 of the motor 69 drives a connecting rod 67 which is coupled to and serves to oscillate the second portion 73 of the pendulum 63, 73 about the vertical axis B.

The stroke or throw of the connecting rod 67 receiving motion from the output element 71 of the motor 69 is assumed to be constant and is determined by the dimensions and mounting of an eccentric 74 forming part of the coupling between the motor 69 and the portion 73 of the pendulum.

The shifting means 61 is preferably designed to select the extent of reciprocation of the eyelet 68 (and hence of the thread 48 between the source 50 and the growing bobbin 49 in the chamber 43) in dependency on the selected distance a between the end walls 9 and 11. This can be achieved by moving the connecting rod 67 relative to the adjacent end of the upper portion 73 of the pendulum 63, 73. The locus of engagement between the connecting rod 67 and the portion 73 of the pendulum can be moved substantially at right angles to the axis of the winding spindle 31. Even though the throw of the eccentric 74 and the mounting of the connecting rod 67 on the eccentric 74 remain unchanged, the extent of oscillation of the eyelet 68 between the surfaces 10 and 39 can be varied, e.g., by the simple expedient of shifting the exact locus of connection between the rod 67 and the portion 73 of the pendulum 63, 73. The coupling between the connecting rod 67 and the portion 73 includes an elongated slot 77 in the portion 73 and a pin-shaped projection 72 provided on the connecting rod 67 and extending into the slot 77. The position of the projection 72 in the slot 77 can be changed and the projection is thereupon fixed in the selected position at a greater or lesser distance from the axis B.

In lieu of the just described adjusting means for the extent of oscillation or reciprocation of the eyelet 68 between the surfaces 10 and 39, the shifting means 61 can be designed in such a way that the pivot 75 (defining the axis B) is movable in order to change the ratio of effective lengths of the portions 63, 73 of the pendulum. Still further, it is possible to employ a pendulum portion 63 whose effective length between the axis B and the eyelet 68 is variable to thus determine the extent of oscillation of the eyelet 68 between the surfaces 10 and 39.

In order to simplify the selection of distance a between the end walls 9 and 11, namely to ensure that such distance can be varied without changing the axial positions of both end walls, the elongated slot 77 in the pendulum portion 73 is preferably normal to the axis of the spindle 31 when the eyelet 68 is adjacent (and preferably abuts) the surface 39 and/or the coplanar surface of the carrier 5. This ensures that the eyelet 68 reaches its right-hand end position (as viewed in FIG. 2) when the slot 77 is normal to the axis of the spindle 31. This holds true irrespective of the selected extent of oscillation of the portion 63 of the pendulum 63, 73 about the axis B, i.e., one end position of the eyelet 68 remains unchanged. This renders it possible to select the distance a by the simple expedient of moving the member 13 and the end wall 11 relative to the end wall 9 and its carrier 5. Thus, in order to change the distance a, the operator or an automatic adjusting system simply moves the member 13 and the end wall 11 toward or away from the end wall 9 (subsequent to loosening of the fasteners 41), and the extent of oscillation of the eyelet 68 is thereupon adjusted accordingly by changing the position of the projection 72 in the elongated slot 77 of the pendulum portion 73.

A portion of the connecting rod 67 which is spaced apart from the projection 72 carries a bearing sleeve 66 surrounding an eccentrically mounted post 70. In order to adjust the portion 63 of the pendulum 63, 73, the connecting rod 67 is moved axially of the output element 71 of the motor 69. The means for guiding the connecting rod 67 during such movement includes a groove 76 which is machined into or is otherwise formed in the carrier for the shifting means 61. The motor 69 shares the movement of the connecting rod 67 along the groove 76. The means for moving the motor 69 and the connecting rod 67 along the groove 76 comprises a rotary feed screw 78 which can be rotated by a crank 79. Alternatively, or in addition to the manually operated moving means 78, 79, the shifting means 61 can include a suitable prime mover (e.g., an electric motor 80 which is indicated in FIG. 2 by broken lines). Such prime mover can move the casing or housing of the motor 69, or it can be used in lieu of the crank 79 to rotate the feed screw 78 and to thereby move the motor 69 and the connecting rod 67 in the longitudinal direction of the groove 76.

The winding apparatus 3 further comprises an arrangement 81 which can be operated to constitute a means for grasping the thread 48 between the source 50 and a fully grown bobbin 49 subsequent to evacuation of such bobbin from the chamber 43, e.g., into the compartment 53 beneath the end walls 9 and 11. The illustrated grasping arrangement 81 comprises an elongated holder 85 whose axis coincides with the axis F of the spindle 31 and which is reciprocable in the carrier 17 (i.e., in the support or frame of the apparatus 3) by a double-acting fluid-operated linear motor 89 (e.g., a pneumatic cylinder and piston unit) mounted on the carrier 17. The holder 85 is reciprocable in a top portion 83 of the carrier 17 at a level above the guides 15 for the member 13 and its end wall 11. The top portion 83 can be said to constitute a bearing for the holder 85 and can be a separately produced part which is thereupon affixed to the carrier 17 or is otherwise mounted on the base 1 so as to maintain the holder 85 in axial alignment with the spindle 31. The forward end of the holder 85 carries a thread looping device 87 which can be moved by the motor 89 from an extended position in the chamber 43 to a retracted position in or behind the opening 27 in the end wall 11. The thread looping device 87 can include or constitute one or more tongs 88 or analogous implements which can engage the thread 48 in the chamber 43 and thereupon entrain the engaged portion 150 of the thread into (or behind) the opening 27 with simultaneous formation of a loop (shown in FIG. 2 by dotted lines). For example, the device 87 can comprise two tongs 88 which can be opened and closed by a suitable mechanism (not specifically shown) in selected axial positions of the holder 85. Furthermore, the tongs 88 is or are dimensioned, mounted and manipulated in such a way that the device 87 is sufficiently collapsed or contracted prior to entering the opening 27 from behind or prior to being retracted from the chamber 43 into the opening 27 so that the device 87 and its tongs 88 can advance through the opening 27 into the chamber 43 or from the chamber 43 into and, if desired or necessary, behind the opening 27.

The tongs 88 will open, preferably automatically, in response to entry into the chamber 43 by way of the opening 27, the tongs thereupon engage the thread 48 between the source 50 and the evacuated bobbin 49 (e.g., a bobbin in the compartment 53), and the motor 89 is thereupon started in a direction to withdraw the tongs 88 and the engaged portion 150 of the thread 48 into the opening 27. The arrangement is or can be such that a suitable mechanism (not shown) opens the tongs 88 upon entry into the chamber 43 and that the tongs 88 will close in automatic response to retraction into the opening 27. The tongs 88 can open to release the looped portion 150 of the thread 48 while still in the opening 27 or subsequent to retraction behind the member 13 (see FIG. 1). For example, the grasping arrangement 81 can be equipped with one or more electromagnets (not shown) which serve to open and/or close the tongs 88 and/or to move the tongs to position(s) of readiness for advancement through the relatively small opening 27 in the end wall 11 and the aligned opening in the member 13.

The mode of operation of the winding apparatus 3 is as follows:

When the front end portion 37 of the spindle 31 engages the looped portion 150 of the thread 48 in the opening 27 of the end wall 11 and the latter is located and fixed at a selected distance a from the end wall 9, the motor 33 is started so that the spindle 31 is rotated at a high speed and draws thread 48 from the source 50. This results in the formation of a growing bobbin 49 in the chamber 43 between the confronting surfaces 10, 39 of the respective end walls 11 and 9. The motor 69 is on, e.g., in response to starting of the motor 33, so that the eyelet 68 at the free end of the portion 63 of the pendulum 63, 73 oscillates the adjacent portion of the thread 48 between the two end walls 9, 11 with attendant predetermined distribution of thread on the growing bobbin 49. The shifting means 61 is preferably set up in such a way that the extent of oscillation of the eyelet 68 at least matches (and preferably slightly exceeds) the selected distance a so that the eyelet 68 repeatedly contacts the surface 39 and/or the surface 10 at the end of the respective stroke. Such adjustment of the shifting means 61 might entail some wear upon the eyelet 68 and/or upon the end wall 9 and/or 11 (and/or upon the carrier 5 and/or member 13, depending upon whether the eyelet 68 strikes the end wall 9 or 11 or the adjacent surface of the carrier 5 or member 13); however, it ensures the making of a short or long series of bobbins 49 having predetermined dimensions in their axial direction (i.e., in the direction of the axis F while the spindle 31 is in the process of building or forming a bobbin 49 in the winding chamber 43). Moreover, such adjustment of the shifting means 61 invariably ensures that the eyelet 68 changes the direction of its movement between the end walls 9 and 11 at predetermined locations (upon engagement with the surfaces 10 and 39); this, too, contributes to the making of bobbins 49 having desired axial lengths.

When a bobbin 49 in the chamber 43 is fully grown, e.g., because the arm or arms 47 for the rotary body 45 reach predetermined angular positions, the motor 31 is arrested to thus interrupt the withdrawal of thread 48 from the source 50. It is equally possible to utilize a monitoring device other than the rotary body 45, e.g., a timer which automatically arrests the motor 33 after a predetermined interval of time or after a predetermined number of revolutions thus indicating that the bobbin 49 in the chamber 43 contains a predetermined quantity of thread 48. The motor 69 is arrested simultaneously with the motor 33, i.e., the eyelet 68 ceases to oscillate between the end walls 9 and 11. The next step involves retraction of the member 13 and of the end wall 11 therein (e.g., through a distance in the range of one or more millimeters) in a direction away from the end wall 9. The motor 46 is thereupon started to retract the motor 33 and the spindle 31 in a direction away from the carrier 17 so that the end portion 37 of the spindle is retracted into the opening 25 of the end wall 9 or into the aligned opening of the carrier 5. The end walls 9, 11 then cease to clamp the fully grown bobbin 49 and the latter is ready for evacuation (e.g., by gravity) into the compartment 53. Retraction of the spindle 31 from the chamber 43 can take place simultaneously with or immediately or shortly after retraction of the end wall 11 in a direction away from the end wall 9. If the bobbin 49 is to be actually expelled from the chamber 43, the winding apparatus 3 can be equipped with the aforementioned doffer or with other suitable (e.g., mechanical or pneumatic) bobbin evacuating means.

As the bobbin 49 descends from the chamber 43 into the compartment 53 below the end walls 9 and 11, the thread 48 continues to extend between the source 50 and the evacuated bobbin. Since the opening 27 is unoccupied (the spindle 31 has been retracted by the motor 46), the grasping arrangement 81 can be actuated by causing the motor 89 to move the holder 85 in a direction to the right, as viewed in FIG. 1, so that the tongs 88 of the looping device 87 can enter the chamber 43 to engage the thread portion 150. The direction of movement of the holder 85 is thereupon reversed whereby the portion 150 is automatically looped and drawn into the opening 27 of the end wall 11. As shown in FIGS. 1 and 2, the bight of the looped portion 150 of the thread 48 can be withdrawn to a position all the way behind the member 13 and the tongs 88 is or are thereupon caused to release the bight. The next step involves renewed advancement of the spindle 31 in a direction to the left, as viewed in FIGS. 1 and 2, so that the end portion 37 enters the opening 27 and engages the looped portion 150 of the thread 48. As mentioned hereinbefore, the end portion 37 is preferably a snug fit in the opening 27 so that the spindle 31 begins to convolute the thread 48 around its exposed surface in the chamber 43 as soon as the motor 33 is restarted.

The winding apparatus 3 further comprises scissors 80 (shown schematically in FIG. 3), a knife or other suitable means for preferably automatically severing the thread 48 between the chamber 43 and the bobbin 49 in the compartment 53, for example, in response to reintroduction of the end portion 37 of the spindle 31 into the opening 27 of the end wall 11. This ensures that the thread 48 is severed between the source 50 and the fully grown evacuated bobbin 49 in the compartment 53 at a time when the portion 150 of the thread is already clamped by the end portion 37 of the spindle 31.

When the severing step is completed, the motors 33 and 69 are restarted and the winding apparatus 3 proceeds to make a fresh bobbin 49 which is monitored and otherwise manipulated in a manner as described above. 0f course, the member 13 and its end wall 11 are returned to their predetermined positions (at the selected distance a from the end wall 9) before the motors 33 and 69 are restarted to proceed with the building of a bobbin 49 in the chamber 43.

The so-called winding ratio (namely the ratio of the rotational speed of the spindle 31 to the extent of reciprocation or oscillation of the eyelet 68) can be selected in a fully automatic way, e.g., electronically by appropriate regulation of the RPM of the motor 33 (spindle 31) and motor 69 (output element 71). Such ratio influences the characteristics of the finished bobbins 49.

If the making of a series of relatively long or short bobbins 49 is to be followed by the making of a series of shorter or longer bobbins, the fasteners 41 are loosened and the distance a is altered. Also, the extent of oscillation of the eyelet 68 is altered, e.g., by the aforedescribed expedient of moving the motor 69 and the connecting rod 67 along the groove 76.

Figure 4:
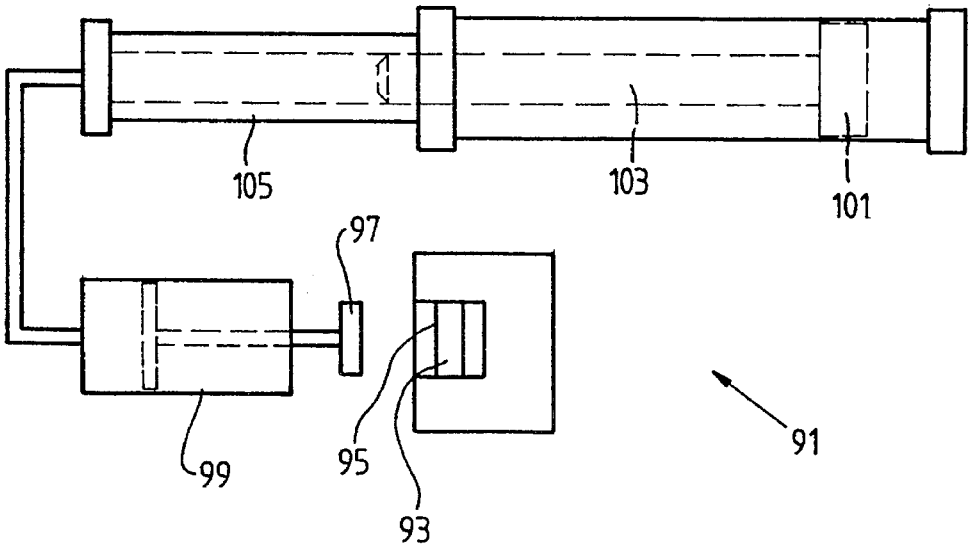
FIG. 4 is a schematic plan view of a combined heating and compacting unit for fully grown all-thread bobbins.

FIG. 4 illustrates certain details of a combined heating and compacting unit 91 which can be put to use in order to influence certain characteristics of fully grown bobbins 49, e.g., the axial length and the diameters of cylindrical or substantially cylindrical bobbins. A bobbin 49 which has been evacuated from the winding chamber 43 into the compartment 53 of the winding apparatus 3 of FIGS. 1 to 3 can be removed from the compartment 53 (by hand or automatically) and introduced into the unit 91, namely into the socket of a heatable matrix 93 having an internal surface 95 surrounding a properly inserted fully grown bobbin 49. The socket of the matrix 93 is aligned with a reciprocable ram 97 which is movable back and forth by a suitable prime mover 99 (e.g., a double-acting hydraulic or pneumatic motor). It is presently preferred to employ a hydraulic motor 99 which operates with oil or with another suitable hydraulic fluid. In order to avoid the use of an oil pump, the pressure in the cylinder of the illustrated motor 99 can be raised to a desired value by a pressure regulating assembly including a first motor having an elongated cylinder for a reciprocable piston 101. The piston rod 103 of the piston 101 extends into a receptacle 105 which is filled with oil. As the piston 101 moves in a direction to the left (reference being had to FIG. 4), the pressure of oil in the receptacle 105 (and hence in the cylinder chamber of the motor 99) rises accordingly to ensure requisite compacting of the fully grown bobbin in the socket of the matrix 93. At the same time, the heated surface 95 of the matrix 93 maintains the properly inserted bobbin at a desired temperature.

The treatment of fully grown bobbins in the unit 91 of FIG. 4 is often desirable if the convolutions of the thread 48 forming such bobbin are to slightly adhere to each other with a predetermined force and/or if each bobbin 49 is to assume an accurately determined size and shape prior to actual use, e.g., to furnish underthread in a sewing machine. Adherence of neighboring filaments in a fully grown bobbin 49 to each other can be ensured by the customary sizing or finishing preparation which has been applied to the thread 48 on the reel at the source 50. Alternatively, and if the thread 48 is a synthetic filament, heating in the socket of the matrix 93 can result in some softening of plastic material and hence in desired adherence of neighboring convolutions of the all-thread bobbin to each other.

The unit 91 of FIG. 4 can be installed in or on or at the support of the winding machine 3. Alternatively, the unit 91 can constitute an independent machine or apparatus which is installed adjacent to or at a selected distance from the winding machine 3 of FIGS. 1 to 3.

An important advantage of the improved method and winding apparatus 3 is that each of a short or long series of bobbins 49 can be imparted a desired size and/or shape and/or consistency with a high degree of accuracy and reproducibility. Moreover, the apparatus is relatively simple and its operation can be automated to any desired extent. In addition, a bobbin 49 can contain a larger quantity of thread 48 than a conventional bobbin having identical outer dimensions because the diameter of the axial passage (upon extraction of the spindle 31) is very small. This is due to the fact that the aforediscussed making of the loop 150 by the grasping means 81 suffices to ensure reliable engagement of looped portion 150 by the end portion 37 of the spindle 31 (when the end portion 37 is returned into the opening 27 of the end wall 11) so that the making of a fresh bobbin 49 can begin in automatic and immediate response to restarting of the motor 33.

An advantage of the pressing means 45, 51 (or analogous pressing means) is that a growing bobbin 49 can be compacted with a selected force while its diameter grows as a result of withdrawal of thread 48 from the source 50 by the rotating spindle 31. The pressing action is or can be uniform all the way between the end walls 9 and 11. If the pressing means 45, 51 (or analogous pressing means) is used jointly with the unit 91 of FIG. 4 (or an analogous unit), the quantity of thread 48 in a finished bobbin 49 (which has been removed or expelled from the socket of the matrix 93) can exceed the quantity of thread in a conventionally produced bobbin having identical outer dimensions to a surprisingly large extent. For example, mere treatment of a bobbin 49 in the unit 91 of FIG. 4 can result in an increase of the quantity of thread (as compared with the quantity of thread in a conventionally produced bobbin having the same outer diameter and the same axial length) by 10–20 percent.

The end walls 9, 11 are or can be mounted (in the carrier 5 and member 13) in such a way that they act not unlike idler rollers, i.e., that they are set in motion by the adjacent portions of a growing bobbin 49 in the chamber 43. This reduces the likelihood of damage to thread 48 at the locations where the thread contacts the end walls 9 and 11. Moreover, such ability of the end walls 9, 11 to be driven by and to rotate with a growing bobbin 49 renders it possible to drive the spindle 31 at an elevated speed so that the making of a bobbin 49 takes up a very short interval of time.

The shifting means 61 has been found to ensure highly satisfactory distribution of thread 48 in successively grown bobbins 49. Moreover, such shifting means renders it possible to rapidly and accurately conform the extent of oscillation of the eyelet 68 to the selected distance a between the surfaces 10 and 39 of the respective end walls 11 and 9. More specifically, the adjustment of shifting means 61 in dependency on the selected distance a renders it possible to properly distribute the thread 48 all the way between the surface 10 of the end wall 11 and the surface 39 of the end wall 9.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of making an all-thread bobbin on a rotary spindle between first and second end walls at least one of which is adjustable axially of the spindle to define with the other end wall a winding chamber of selected length, comprising the steps of establishing a source of thread having a portion extending into the chamber; moving the spindle axially across the chamber between the end walls and into an opening in the first end wall; rotating the spindle to wind the portion of and thereupon additional thread around the spindle in the chamber with attendant formation of a growing bobbin; shifting the thread back and forth between the first and second end walls intermediate the source and the growing bobbin so that the growing bobbin extends across the chamber between the end walls; arresting the spindle when the bobbin in the chamber is fully grown by containing a predetermined quantity of thread; extracting the spindle from the opening and from the chamber; moving the at least one end wall away from the other end wall to permit evacuation of the grown bobbin from the chamber; grasping a second portion of the thread between the evacuated bobbin and the source; withdrawing the thus grasped second portion of the thread into the opening of the first end wall; and thereupon moving the spindle across the chamber and back into the opening to engage the withdrawn second portion preparatory to renewed rotation of the spindle for the winding of thread therearound.

2. The method of claim 1 of making an all-thread bobbin between first and second end walls having confronting substantially parallel and substantially plane thread-contacting surfaces, wherein the source contains a supply of convoluted thread and said withdrawing step includes looping the grasped second portion of the thread.

3. The method of claim 1, further comprising the step of severing the thread between the second portion and the evacuated bobbin.

4. The method of claim 1, wherein said grasping step includes clamping the second portion of the thread by tongs and pulling the clamped second portion from the chamber into the opening of the first end wall.

5. The method of claim 4, wherein the pulling step includes advancing the second portion of the thread all the way through an opening extending through the entire first end wall.

6. The method of claim 1, further comprising the step of pressing the growing bobbin in the chamber substantially radially inwardly toward the rotating spindle.

7. The method of claim 6, wherein said pressing step includes biasing a rotary body against the growing bobbin with a variable force.

8. The method of claim 1, further comprising the step of rotating at least one of the end walls by the growing bobbin in the chamber.

9. The method of claim 1, wherein said shifting step includes guiding the thread through an eyelet of a pendulum which is oscillated between first and second end positions at least close to the first and second end walls, respectively.

10. The method of claim 1, further comprising the step of varying, in the course of said shifting step, the extent of shifting the thread back and forth between the end walls intermediate the source and the growing bobbin.

11. Apparatus for winding all-thread bobbins, comprising a support; a rotary spindle axially movably mounted in said support; first and second end walls mounted in said support, said end walls defining a winding chamber and having aligned openings for said spindle; means for rotating said spindle to thereby wind a thread which is supplied by a source of supply and to thus form a growing bobbin in said chamber; means for moving said spindle axially in one of said openings across said chamber into the other of said openings and for extracting said spindle from said other opening and said chamber, at least one of said end walls being adjustable relative to the other of said end walls to permit evacuation, upon extraction of the spindle from said chamber, of a fully grown bobbin containing a predetermined quantity of thread; and means for grasping a portion of the thread between the source and the evacuated fully grown bobbin, including means for pulling the grasped portion of the thread into said other opening upon extraction of the spindle from said other opening.

12. The apparatus of claim 11, further comprising means for severing the thread between the evacuated fully grown bobbin and said chamber, and means for shifting the thread back and forth between said end walls intermediate the source and the growing bobbin in said chamber.

13. The apparatus of claim 12, wherein said grasping means comprises means for looping said portion of the thread as a result of pulling said portion of the thread from said chamber into said other opening.

14. The apparatus of claim 13, wherein said source contains a supply of convoluted thread and said portion of the thread is engaged by and is compelled to rotate with said spindle upon renewed movement of the spindle into said other opening and upon renewed rotation of the spindle whereby the thread is wound around the spindle and forms a further growing bobbin in said chamber.

15. The apparatus of claim 13, wherein said pulling means comprises means for reciprocating said looping means axially of the spindle through said other opening into and out of said chamber upon extraction of the spindle from said other opening and said chamber.

16. The apparatus of claim 15, wherein said looping means comprises tongs operable to clamp the thread in said chamber upon evacuation of the fully grown bobbin and prior to severing of the thread between the evacuated bobbin and said chamber.

17. The apparatus of claim 12, wherein said spindle comprises an end portion which cooperates with the end wall having said other opening to non-rotatably engage said spindle with said portion of the thread in said other opening upon renewed movement of the spindle into said other opening.

18. The apparatus of claim 11, wherein said shifting means comprises an oscillatable thread engaging device and means for oscillating said device between said end walls.

19. The apparatus of claim 18, wherein said device includes a pendulum and said means for oscillating comprises means for repeatedly moving said pendulum into abutment with at least one of said end walls.

20. The apparatus of claim 18, wherein said shifting means further comprises means for varying the extent of oscillation of said device in dependency on the adjustment of said at least one end wall relative to the other end wall.

21. The apparatus of claim 20, wherein said device is oscillatable about a second axis extending transversely of the axis of said spindle and located between said end walls, said device having a first arm which engages the thread between the source and the growing bobbin and a second arm connected with said oscillating means, said second arm having a variable effective length between said second axis and said oscillating means to thus vary the extent of oscillation of engaged thread between said end walls.

22. The apparatus of claim 20, wherein said device is oscillatable about a second axis extending transversely of the axis of said spindle and located between said end walls, said device having a thread engaging first arm and a second arm and said shifting means further comprising means for coupling said second arm with said oscillating means at any one of a plurality of different distances from said second axis to thereby select the extent of oscillation of engaged thread between said end walls.

23. The apparatus of claim 11, further comprising means for pressing the growing bobbin substantially radially inwardly toward the spindle in said chamber.

24. The apparatus of claim 23, wherein said means for pressing comprises a rotary body and means for biasing said rotary body against the growing bobbin in said chamber with a variable force.

25. The apparatus of claim 11, further comprising means for monitoring the growth of the bobbin in said chamber.

* * * * *